US007494102B1

(12) United States Patent
Deal

(10) Patent No.: US 7,494,102 B1
(45) Date of Patent: Feb. 24, 2009

(54) HOLDER FOR MEDICAL ALARMING DEVICE

(76) Inventor: Robert B. Deal, 5070 Lincoln St. East, Canton, OH (US) 44730

( * ) Notice: Subject to any disclaimer, the term of this patent is extended or adjusted under 35 U.S.C. 154(b) by 0 days.

(21) Appl. No.: 11/906,357

(22) Filed: Oct. 2, 2007

(51) Int. Cl.
*A47G 29/02* (2006.01)

(52) U.S. Cl. ..... 248/340; 5/503.1; 220/482; 248/314

(58) Field of Classification Search ..... 248/340, 248/322, 304, 311.2, 314, 312.1; 5/503.1, 5/658; 220/482, 480, 737–743
See application file for complete search history.

(56) References Cited

U.S. PATENT DOCUMENTS 3,029,789 A * 4/1962 Fisher ..... 119/347
3,717,188 A * 2/1973 Green ..... 224/42.11
4,491,257 A * 1/1985 Ingles ..... 224/407
4,535,921 A * 8/1985 Sanders ..... 223/106
4,593,812 A * 6/1986 Dillingham ..... 206/292
5,282,599 A * 2/1994 Arpaia et al. ..... 248/311.2
5,660,298 A * 8/1997 Thompson ..... 220/482
5,692,608 A * 12/1997 Simien ..... 206/320
5,703,945 A * 12/1997 Smith ..... 379/446
D393,389 S * 4/1998 Thurston-Chartraw et al. ..... D6/523
6,253,399 B1 * 7/2001 Wagner ..... 5/507.1
D567,557 S * 4/2008 Snell ..... D6/523
2005/0051690 A1 * 3/2005 Phillips et al. ..... 248/311.2

* cited by examiner

*Primary Examiner*—Ramon O Ramirez
(74) *Attorney, Agent, or Firm*—Sand & Sebolt

(57) ABSTRACT

A handheld holder is mountable on a support structure such as a bed headboard or seat back of a wheel chair and holds a body of a medical alarming device having an alarming switch and a cord extending outwardly from the switch. Typically, a downwardly opening support-receiving space receives the support structure to support the holder thereon and an upwardly opening medical alarming device-receiving space receives and supports the body of the alarming device. The holder may include a flexible outer skin or sleeve preferably formed of a non-scratching material such as a textile. One or more elastic straps are typically used to secure the body of the alarming device, and preferably are configured to alternately secure bodies of different sizes. A substantially rigid frame of the holder may have an S-shaped configuration, may be formed as an integral one-piece member and may have a flat plate construction.

20 Claims, 5 Drawing Sheets

HOLDER FOR MEDICAL ALARMING DEVICE

BACKGROUND OF THE INVENTION

1. Technical Field

The present invention relates generally to medical alarming devices which are used to warn medical or other personnel when someone has fallen and needs assistance. More particularly, the invention relates to a holder for such an alarming device which is mountable on the headboard of a bed, the seat back of a wheelchair and the like.

2. Background Information

It is well known in the medical field to provide a medical alarming device which activates an audible or visual alarm when someone has fallen out of bed, out of a wheelchair, out of a standard chair or otherwise. Such devices are typically of a handheld size and include a magnetic omni-directional switch with a cord attached to the switch extending outwardly therefrom. At the free end of the cord an alligator clip or other mounting mechanism is used to clip to a person's clothes so that when he or she falls, the cord is tightened and moves the omni-directional switch to activate the alarm.

While such devices have proven highly useful, one problem that has arisen is the need to secure the alarming the device during use so that it is not damaged by itself falling on the floor and so forth. It has been observed in nursing homes that these devices are typically haphazardly mounted on a wheelchair or bed by a makeshift apparatus so that the alarming devices are indeed dropped and damaged. The falling of device may also inadvertently set off the alarm. Thus, there is a need in the art for a simple and cost effective holder to prevent such damage.

BRIEF SUMMARY OF THE INVENTION

The present invention provides a handheld holder for holding a body of a first medical alarming device having an alarming switch and a cord extending outwardly from the switch, the holder comprising: a mounting portion; a downwardly opening support-receiving (SR) space formed in the mounting portion adapted for receiving therein a support structure for supporting the holder thereon; a holder portion; and an upwardly opening medical alarming device-receiving (ADR) space adapted for receiving and supporting the body of the first alarming device therein.

DETAILED DESCRIPTION OF THE INVENTION

Figure 1:
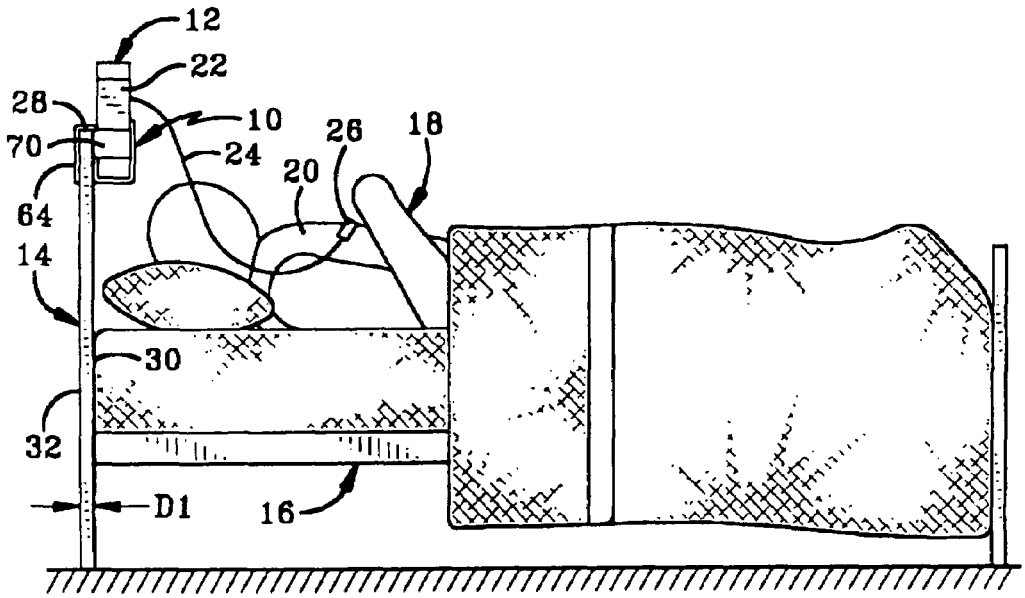
FIG. 1 is a diagrammatic side elevational view of the holder of the present invention holding the larger alarming device and mounted on the headboard of a bed.
Figure 3:
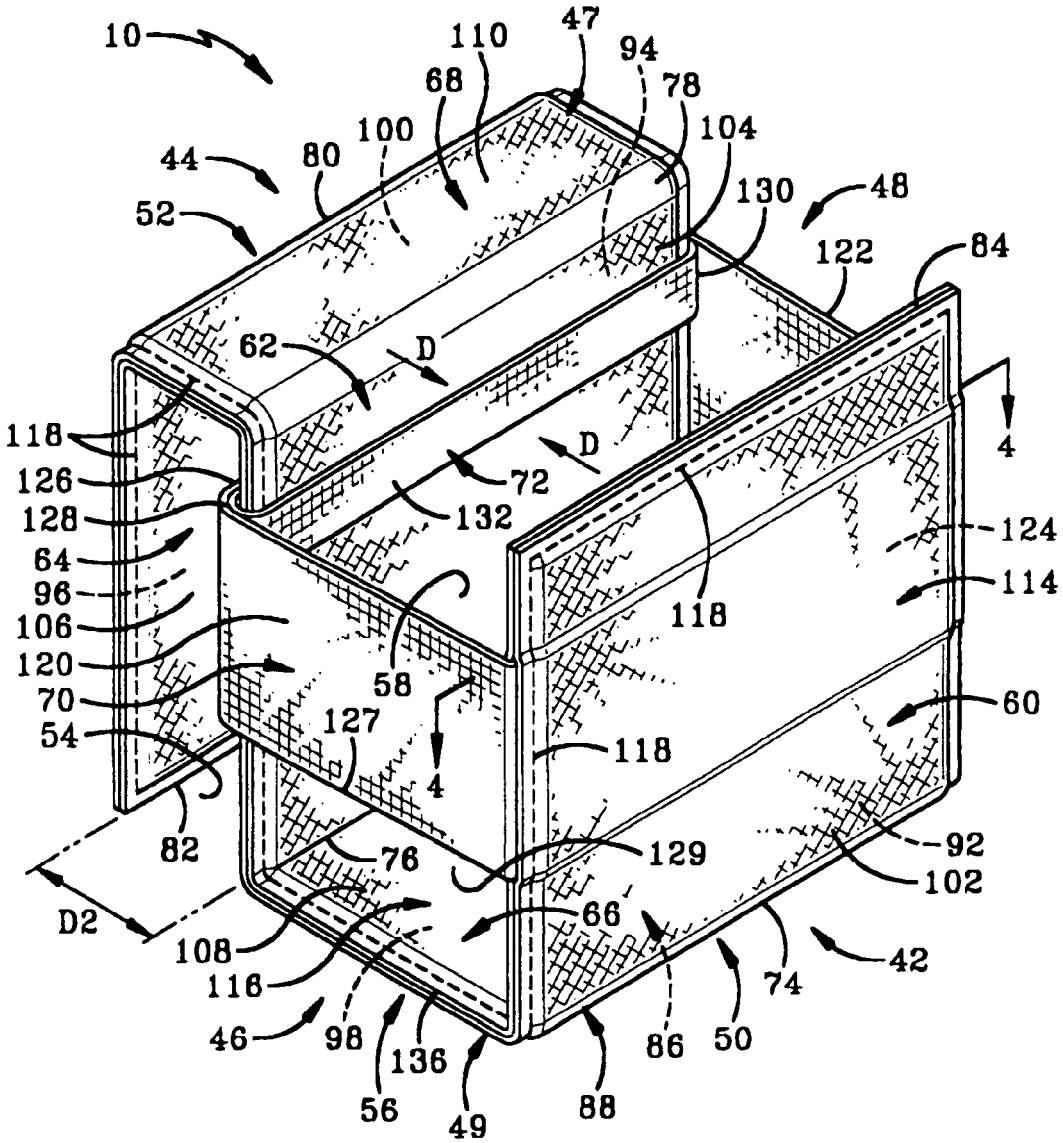
FIG. 3 is a perspective view of the holder.

The handheld holder of the present invention is shown generally at 10 in FIG. 3. Holder 10 is shown in FIG. 1 holding a larger handheld alarming device 12 mounted on a headboard 14 of a bed 16 in which a person 18 wearing clothing 20 is laying down. Alarming device includes a generally rectangular body 22, a flexible cord 24 connected to and extending outwardly therefrom and a mounting device in the form of an alligator clip 26 at the free end of cord 24. More particularly, device 12 includes an omni-directional switch 25 (FIG. 5) which is moveably mounted on body 22 with cord 24 connected to and extending outwardly from switch 25 so that switch 25 is activatable by pulling cord 24 in any direction. Clip 26 is clipped or otherwise secured to clothing 20. Headboard 14 has an upper end 28 and front and rear finished surfaces 30 and 32 defining therebetween a thickness D1 of headboard 14. As noted in the Background section of the present application, alarming device 12 is configured to set off an audible or visual alarm which may be onboard and or at a remote location so that a caretaker may hear or see the alarm or signal which is set off when person 18 falls out of bed 16 so that cord 24 is pulled to activate switch 25.

Figure 2:
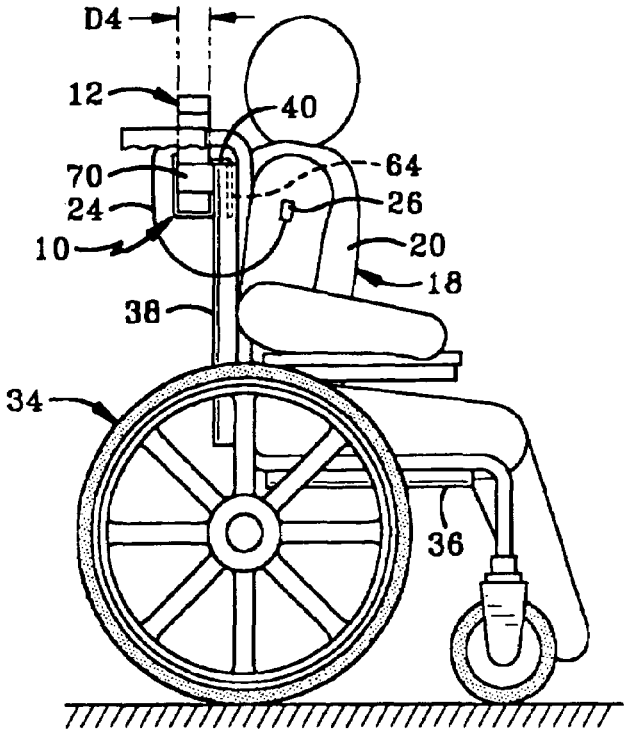
FIG. 2 is a diagrammatic side elevational view of the holder holding the larger alarming device and mounted on the seat back of a wheelchair.

FIG. 2 shows holder 10 mounted on a wheelchair 34 which includes a frame supported by plurality of wheels and on which is mounted a generally horizontal seat bottom 36 and a generally vertical seat back 38 extending upwardly above seat bottom 36. Seat back 30 has an upper end 40 adjacent which holder 10 is mounted. FIG. 2 shows person 18 seated on seat bottom 36 with his back against seat back 38 and with clip 26 clipped to clothing 20. While holder 10 is typically used to mount alarming device 12 on a seat back 38 of wheelchair 34 or at the upper end 28 of headboard 14, it may be mounted on any other suitable support structure. Thus, for instance, wheelchair 34 also represents a standard chair having a seat back on which holder 10 may be mounted.

With reference to FIG. 3, holder 10 is described in greater detail. Holder 10 has a front 42 and a rear 44 defining therebetween a longitudinal direction of holder 10, first and second sides 46 and 48 defining therebetween an axial direction of the holder, and a top 47 and a bottom 49 defining therebetween the height of holder 10. Front 42 and rear 44 also define therebetween a depth of holder 10 which is typically within the range of 1¼ to 4½ inches; more typically 1¾ to 4 inches; more typically 2¼ to 3½ inches and in the exemplary embodiment 2¾ to 3¼ inches. First and second sides 46 and 48 define therebetween a width of holder 10 which is typically within the range of 2 to 4½ inches; more typically 2½ to 4 inches; more typically 3 to 3½ inches; and in the exemplary embodiment about 2¾ to 3¼ inches. Likewise, top 47 and bottom 49 define therebetween a height of holder 10 typically falling within the same ranges given for the width of holder 10. Holder 10 includes an S-shaped frame 50 comprising a mounting portion 52 adjacent rear 44 which defines a support-receiving space 54 which opens downwardly and to either side 46 and 48. Frame 50 further includes a holder portion 56 disposed forward of mounting portion 52 adjacent front 42 and defining a first larger alarming device-receiving space 58 which opens upwardly and to sides 46 and 48. Frame 50 includes a front wall 60, an intermediate wall 62, and a back wall 64, each of which are substantially flat and parallel to one another and are disposed in respective axially extending vertical planes. Frame 50 further includes a laterally extending substantially horizontal bottom wall 66 which extends between and is connected to the bottom ends of front wall 60 and intermediate wall 62. Frame 50 further includes a laterally extending and substantially horizontal top wall 68 which extends between and is connected to the upper ends of intermediate wall 62 and back wall 64. Intermediate wall 62 and a back wall 64 define therebetween a normal distance D2 which is preferably the same as or only slightly larger than distance or thickness D1 of headboard 14 so that holder 10 may be slid downwardly from a removed or uninstalled position to an installed position on headboard 14 to receive upper end 28 therein with a sufficiently firm grip to prevent holder 10 from inadvertently being knocked off of headboard 14 while allowing for a reasonably easy installation and removal from headboard 14. Intermediate wall 62 has a rearwardly facing engaging surface which bounds space 54. Likewise, back wall 64 has a forward facing engaging surface which bounds space 54. These two engaging surfaces slidably engage front and rear surfaces 30 and 32 during installation and removal of holder 10. Although distances D1 and D2 may vary, one standard headboard width is preferably approximately ¾ inch and thus distance D2 is approximately ¾ inch or slightly larger than that in the exemplary embodiment. Typically, intermediate wall 62 and back wall 64 are substantially parallel and thus distance D2 typically defines the normal distance between these two parallel walls. However, walls 62 and 64 may not be parallel and thus distance D2 may vary from the top to the bottom of space 54. While distance D2 is preferably suitable to accommodate headboard 14, it may also be formed for use with the seat back of wheelchair 34 without being large enough to fit onto headboard 14. In that case, distance D2 is typically about ½ inch and more broadly from ¼ inch to ¾ inch, preferably no less the ¼ inch. Typically, distance D2 is no more than ½ inch greater than thickness D1 or the thickness of any support structure on which holder 10 is to be mounted. However, distance D2 may be ½ inch greater than distance D1 or possible larger depending on the specific scenario.

First and second elastic straps 70 and 72 are mounted on frame 50 and bound space 58. In the exemplary embodiment, each of straps 70 and 72 are formed of a woven material comprising elastic bands interwoven with non-elastic cloth or textile material so that the rubber or other elastic material is disposed generally on the interior portion of the strap with the non-elastic woven material forming the inner and outer surfaces of the strap. Thus, the rubber or elastic band or fibers of straps 70 and 72 typically are not in contact with body 22 of device 12 when mounted in holder 10. However, straps 70 and 72 also represent a rubber band or elastic band or a plurality thereof without the use of non-elastic materials so that the rubber band or elastic band may be in contact with the medical device when in holder 10. Each of straps 70 and 72 are in the exemplary embodiment formed of flat thin material. Each of straps 70 and 72 is used in securing an alarming device such as device 12 or the like as will be described in greater detail further below.

With continued reference to FIG. 3, frame 50 is further described. The various walls of frame 50 are connected at several corners which are substantially parallel and extend in the axial direction from first side 46 to second side 48. In particular, these corners includes a bottom front corner 74 from which front wall 60 extends vertically upwardly and bottom wall 66 extends rearwardly to a bottom intermediate corner 76. Intermediate wall 62 extends upwardly from corner 76 to a top intermediate corner 78. Top wall 68 extends rearwardly from corner 76 to a top rear corner 80 from which back wall 64 extends downwardly to a lower terminal edge 82 which is parallel to the corners and extends axially from first side 46 to second side 48. Front wall 60 extends upwardly to an upper terminal edge 84 which is also parallel to the corners and extends from first side 46 to second side 48. In the exemplary embodiment, each of walls 60, 62 and 64 is substantially square so that the height and the width of device 10 are substantially equal although this may vary. In the exemplary embodiment, the depth defined between front and rear 42 and 44 also has substantially the same dimension as the height and width so that the overall shape of device 10 is substantially cubic. Thus, the depth of walls 62 and 68 together in the longitudinal direction is substantially the same as the total depth of device 10 in the longitudinal direction. In the exemplary embodiment, lower terminal edge 82 is at the same height as the bottom of bottom wall 66 so that when device 10 is seated on a flat horizontal surface such as a table top, lower edge 82 and bottom wall 66 contact the flat surface whereby terminal edge 82 adds to the stability of device 10 in a seated position. Thus, when an alarming device such as device 12 is disposed within space 58 and device 10 is seated on a supporting surface instead of hanging from a support such as headboard 14 or seat back 38, device 10 is less easily tipped over.

While various alterations to frame 50 will be apparent to one skilled in the art, it is generally preferred for the sake of simplicity that frame 50 includes only walls 60, 62, 64, 66 and 68. This configuration suits the purpose of holding a device such as device 12 while keeping materials to a relative minimum and allowing for simple formation of device 10 as will be described further below. Thus, with the exception of straps 70 and 72, space 54 is bounded only by walls 62, 64, and 68 while space 58 is bounded only by walls 60, 62 and 66. Other than top wall 68, there are no structures extending from intermediate wall 62 to back wall 64 so that space 54 when not in use is completely empty other than straps 70 and 72, and as previously noted opens downwardly at bottom 50 and to either side 46 and 48. Other than bottom wall 66 and strap 70, there are no structures extending between front wall 60 and intermediate wall 62 so that space 68 is completely empty other than a portion of strap 72. Space 58 thus opens upwardly at top 47 and to sides 46 and 48 other than portions of strap 70 which bound space 58.

Figure 4:
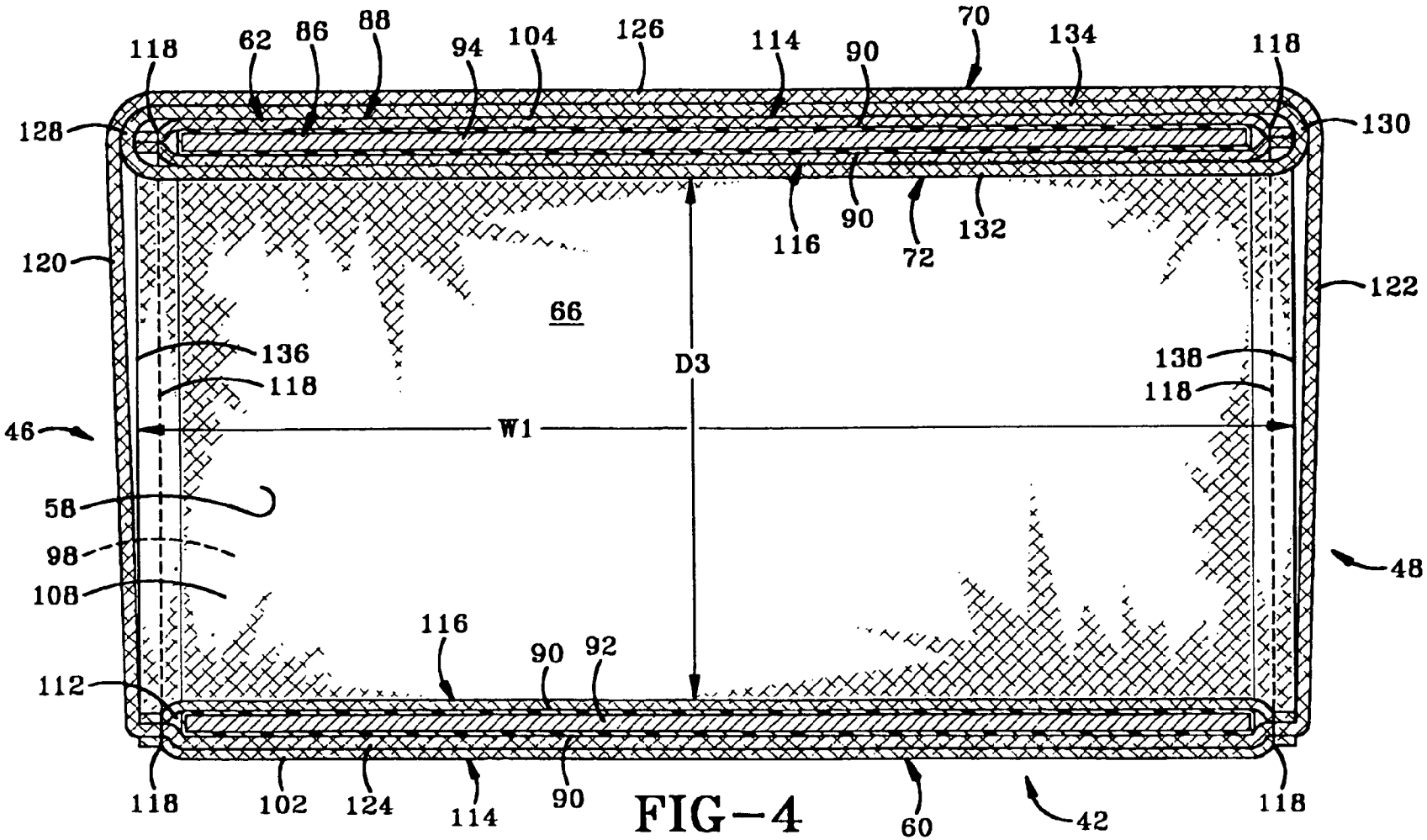
FIG. 4 is a sectional view taken on line 4-4 of FIG. 3.

With reference to FIGS. 3 and 4, frame 50 is further detailed. Frame 50 comprises two primary components, an S-shaped wall 86 which is substantially rigid and an S-shaped sleeve 88 which completely encases wall 86. Wall 86 is usually formed of metal or plastic. An S-shaped coating or outer layer 90 may also completely encase wall 86 if desired and itself be encased by sleeve 88. In keeping with the low cost and simple structure of the invention, S-shaped wall 86 is typically formed as an integral one-piece member and in the exemplary embodiment is formed from flat sheet metal which is bent along the various corners of frame 50 to form the S-shaped configuration. When sheet metal is used to form wall 86, it typically has a thickness ranging from 0.5 to 1.0 millimeters. Stainless steel is used in the exemplary embodiment although other metals or alloys such as aluminum and the like are also suitable. Wall 86 thus includes front, intermediate and rear parallel axially extending flat upright plates 92, 94 and 96 which are longitudinally spaced from one another and lie within respective parallel vertical planes which extend in the axial direction. Each of plates 92, 94 and 96 in the exemplary embodiment is substantially square and more generally typically rectangular. Wall 86 further includes a substantially horizontal flat bottom plate 98 connected to and extending between the lower ends of front and intermediate plates 92 and 94, and a top substantially horizontal flat plate 100 extending to and connected to upper ends of intermediate and rear plates 94 and 96. When S-shaped wall 86 is received within sleeve 88, sleeve 88 includes front, intermediate and rear upright segments 102, 104 and 106 which respectively encase plates 92, 94 and 96 and the corresponding layers 90 when used. Sleeve 88 further includes bottom and top horizontal segments 108 and 110 which respectively encase bottom and top plates 98 and 100 and the corresponding layers 90 when used. Sleeve 88 thus defines an S-shaped interior chamber 112 (FIG. 4) in which S-shaped wall 86 is slidably received during assembly. Layer 90 in the exemplary embodiment is formed of duct tape and thus includes a carrier sheet with an adhesive layer on one side of the carrier sheet which is adhered to the outer surface of S-shaped wall 86. Layer 90 serves in part to cover the edges and corners of wall 86 where the edges intersect, which may otherwise tend to cut into sleeve 88 over time because wall 86 is typically rather thin and thus presents relatively sharp edges and corners. Layer 90 may thus be applied only along the edges and/or corners of wall 86 to dull their sharpness without covering wall 86 entirely.

In the exemplary embodiment, sleeve 88 is formed of flexible sheets of material, most typically a non-scratching cloth or textile material which facilities the ability to slidably receive wall 86 and coating 90 therein, prevents scratching of the finished surfaces 30 and 32 of headboard 14 (FIG. 1) and prevents device 10 from snagging on clothing 20 especially if person 18 is seated in wheelchair 34 (FIG. 1) or the like. In the exemplary embodiment, sleeve 88 includes first and second sheets 114 and 116 of material which prior to assembly of device 10 are substantially flat and rectangular in shape. Sheets 114 and 116 are sewn together their respective outer perimeters as indicated at stitching 118. Stitching 118 extends along each of sides 46 and 48 all the way from adjacent terminal end 82 to adjacent terminal end 84. In addition, stitching 118 extends axially along each of terminal ends 82 and 84 from adjacent first side 46 to adjacent second side 48.

Figure 5:
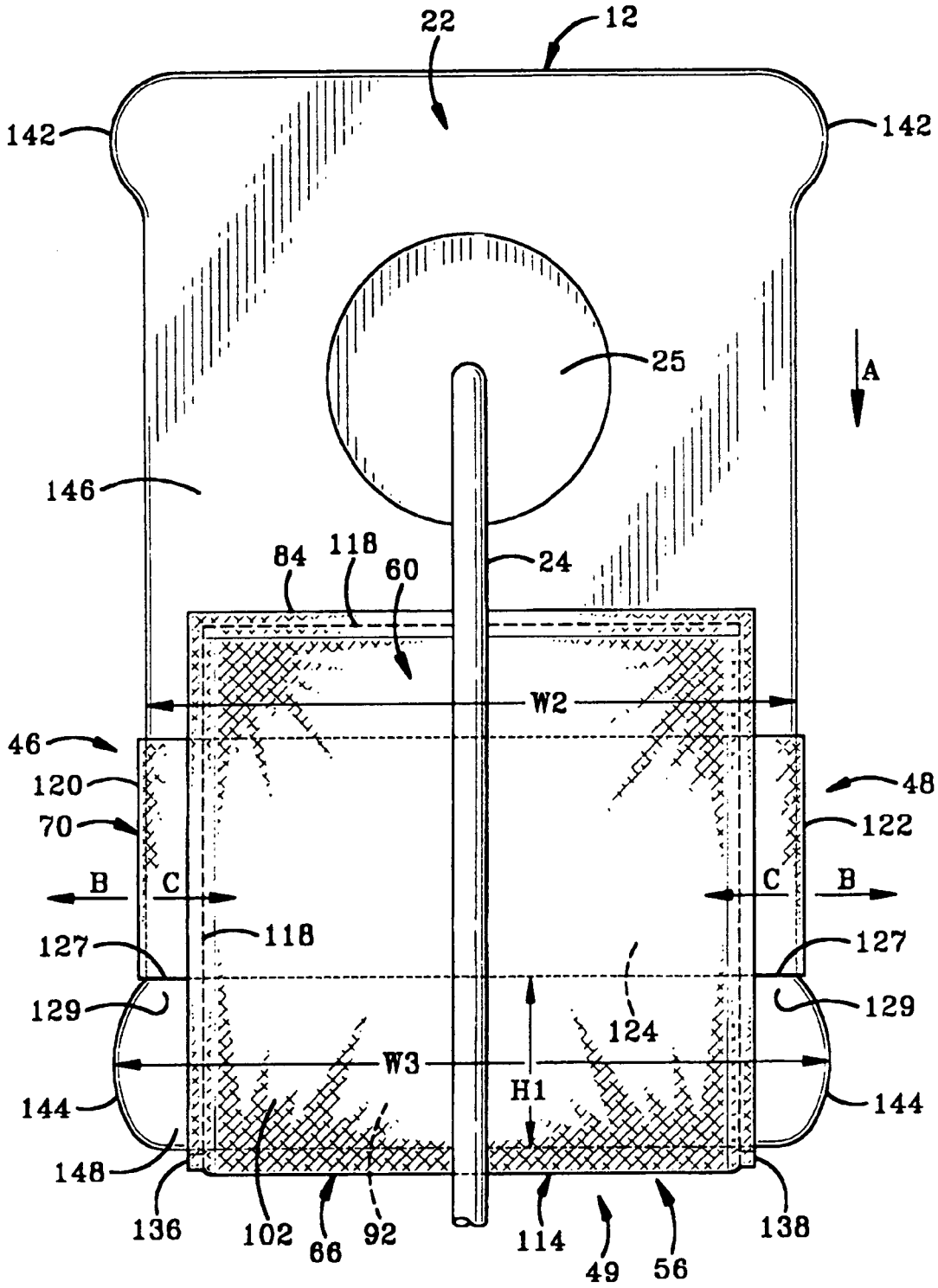
FIG. 5 is a front elevational view of the holder with the larger alarming device held thereby.

With reference to FIGS. 3-4, straps 70 and 72 are described in greater detail. First strap 70 has a home or non-securing position shown in FIGS. 3 and 4 and is stretchable to a stretched securing position shown in FIG. 5. Likewise, second strap 72 has a home or non-securing position shown in FIGS. 3 and 4 and is stretchable to a stretched securing position shown in FIG. 6. First strap 70 includes first and second side segments 120 and 122, a front segment 124 and a rear segment 126 connected to form a continuous loop which circumscribes front and intermediate upright plates 92 and 94 along with the associated outer layer 90 thereon. In the exemplary embodiment, first strap 70 also circumscribes second strap 72 or a portion thereof. First side segment 120 of strap 78 extends longitudinally from one edge of front upright segment 102 of sleeve 88 to a corresponding edge of intermediate upright segment 104 of sleeve 88 along side 46. In the exemplary embodiment, stitching 118 along the edge of front of upright segment 102 doubles to sew strap 70 to first and second sheets 114 and 116 of sleeve 88. Likewise, second side segment 122 extends from the opposed edge of sleeve 88 from front upright segment 102 to intermediate upright segment 104 along second side 48 and is sewn by stitching 118 in the same manner along second side 48 of front segment 102. While segments 120 and 122 may be sewn to the respective edges of intermediate upright segment 104, in the exemplary embodiment strap 70 simply extends around the edges of intermediate segment 104 to its rear segment 126 which extends axially from first side 46 to second side 48 on the rear side of intermediate wall 62. In the exemplary embodiment, front segment 124 of strap 70 is disposed within interior chamber 112 of sleeve 88 within front of upright segment 102. Thus, front segment 124 is disposed behind first sheet 114 and in front of second sheet 116, front upright plate 92 and the corresponding outer layers 90. First strap 70 has a bottom edge 127 which is spaced upwardly from bottom wall 66 so that lower edge 127 and bottom wall 66 along each of first and second sides 46 and 48 define therebetween respective projection-receiving spaces 129 (FIGS. 3, 5). In the exemplary embodiment, first strap 70 is not sewn or otherwise directly connected to intermediate segment 104 or strap 72 and thus may be stretched out of contact with segment 104 and strap 72. More particularly, rear segment 126 and side segments 120 and 122 may be stretched to move rear segment 126 downwardly to a position lower than bottom wall 66 and then forward under bottom wall 66 and upwardly to a position in front of front wall 60 (not shown).

With continued reference to FIGS. 3-4, second strap 72 is further detailed. In the exemplary embodiment, strap 72 is a continuous loop of elastic material which circumscribes an upper portion of intermediate wall 62 adjacent top wall 68. Although strap 70 circumscribes strap 72 in the exemplary embodiment, straps 70 and 72 may be vertically spaced from one another, for example with strap 72 abutting top wall 68 so that strap 70 does not circumscribe strap 72. While strap 72 may be sewn to intermediate segment 104 of sleeve 88, in the exemplary embodiment it simply loops around intermediate wall 62 without any fasteners extending therebetween. Thus, strap 72 may be simply slid off of frame 50, for instance by sliding it upwardly along intermediate wall 62, rearwardly along top wall 68 and downwardly along rear wall 64 and off of terminal lower end 82. Second strap 72 includes first and second arcuate side segments 128 and 130 which are disposed respectively adjacent the opposed edges of intermediate upright segment 104 of sleeve 88, with front and rear segments 132 and 134 connected to and extending therebetween in the axial direction from adjacent first side 46 to adjacent second side 46. Front segment 134 in its home position extends transversely to and typically substantially perpendicular to each of segments 120 and 122 of strap 70 in their respective home positions. While second strap 72 is formed of a flat non-scratching material like strap 70, it is in the exemplary embodiment substantially narrower than strap 70. For instance, in the exemplary embodiment, strap 70 has a width or height between its upper and lower edges which is typically about 1 to 1½ inches while the corresponding dimension of strap 72 is typically about ⅜ to ½ inch. While these dimensions may vary they have been found suitable for the purpose of securing the respective alarming devices as discussed below. In the home position of strap 72, the rear surface of front segment 132 abuts or is closely adjacent the front surface of intermediate upright segment 104 of sleeve 88 while the front surface of segment 132 bounds the rear of first alarm device-receiving space 58. First and second side segments 120 and 122 of first strap 70 likewise have respective inner surfaces which bound the respective sides of space 58. Like support-receiving space 54, space 58 has a parallelepiped configuration having a width W1, a depth D3 and a height defined between bottom wall 66 and top wall 68 or terminal end 84. Width W1 is defined generally between first and second sides 46 and 48 and may be defined between the inner surfaces of first and second segments 120 and 122 of strap 70 or opposed first and second edges 136 and 138 of the various walls bounding space 58, such as front wall 60, intermediate wall 62 and bottom wall 66. Depth D3 may be defined between front and intermediate upright walls 60 and 62 or alternately between front wall 60 and front segment 132 of second strap 72.

Although holder 10 may be assembled in various ways, the exemplary method is now described. Typically, first strap 70 is formed by sewing together opposed ends of a length of strap in order to form the closed loop configuration shown in the exemplary embodiment. First and second sheets 114 and 116 begin as substantially flat rectangular sheets and are sewn together as indicated at stitching 118 with front segment 124 of first strap 70 disposed therebetween adjacent terminal end 84 so that stitching 118 extends along terminal end 84 and along first and second sides 136 and 138 all the way to terminal end 82, which is not stitched initially between sides 46 and 48 and thus left open to slidably receive wall 86 and coating 90 through an entrance opening formed along terminal end 82. Wall 86 begins as a flat rectangular sheet of metal which is bent to form corners 74 and 76 but without forming corners 78 and 80. Outer layer or coating 90 is typically adhered to the sheet metal in its flat rectangular configuration. The initial bending of the metal sheet forms front upright plate 92 and bottom wall 98. At this stage, the portion of the sheet metal which will subsequently form walls 94, 96 and 100 extend vertically upwardly and thus substantially higher than the upper end of front upright 92 in a generally U-shaped configuration. While in this U-shaped configuration, the upper end of upright 92 is slidably inserted into the entrance opening of sleeve 88 along terminal end 82 until it is positioned adjacent terminal end 84 and wall 86 is completely received within sleeve 88. At this stage, the metal sheet has not yet been bent to form corners 78 and 80 and thus sleeve 88 along terminal end 82 extends outwardly beyond the metal sheet a distance which makes it easier to sew terminal end 82 closed with additional stitching 118 along end 82. Once sleeve 88 is thus closed completely around the metal wall, the metal sheet is bent to form corners 78 and 80, thus forming walls 94, 96 and 100. Second strap 72 may then be slid over one of terminal ends 82 and 84, most typically over end 82, then upwardly while looping around back wall 64, then forward around top wall 68 and then downwardly into position looped around the upper portion of intermediate wall 62. First strap 70 is typically looped forward from front wall 62 and thus is stretched downwardly and rearwardly below bottom wall 66 and behind intermediate wall 62 into position.

Figure 6:
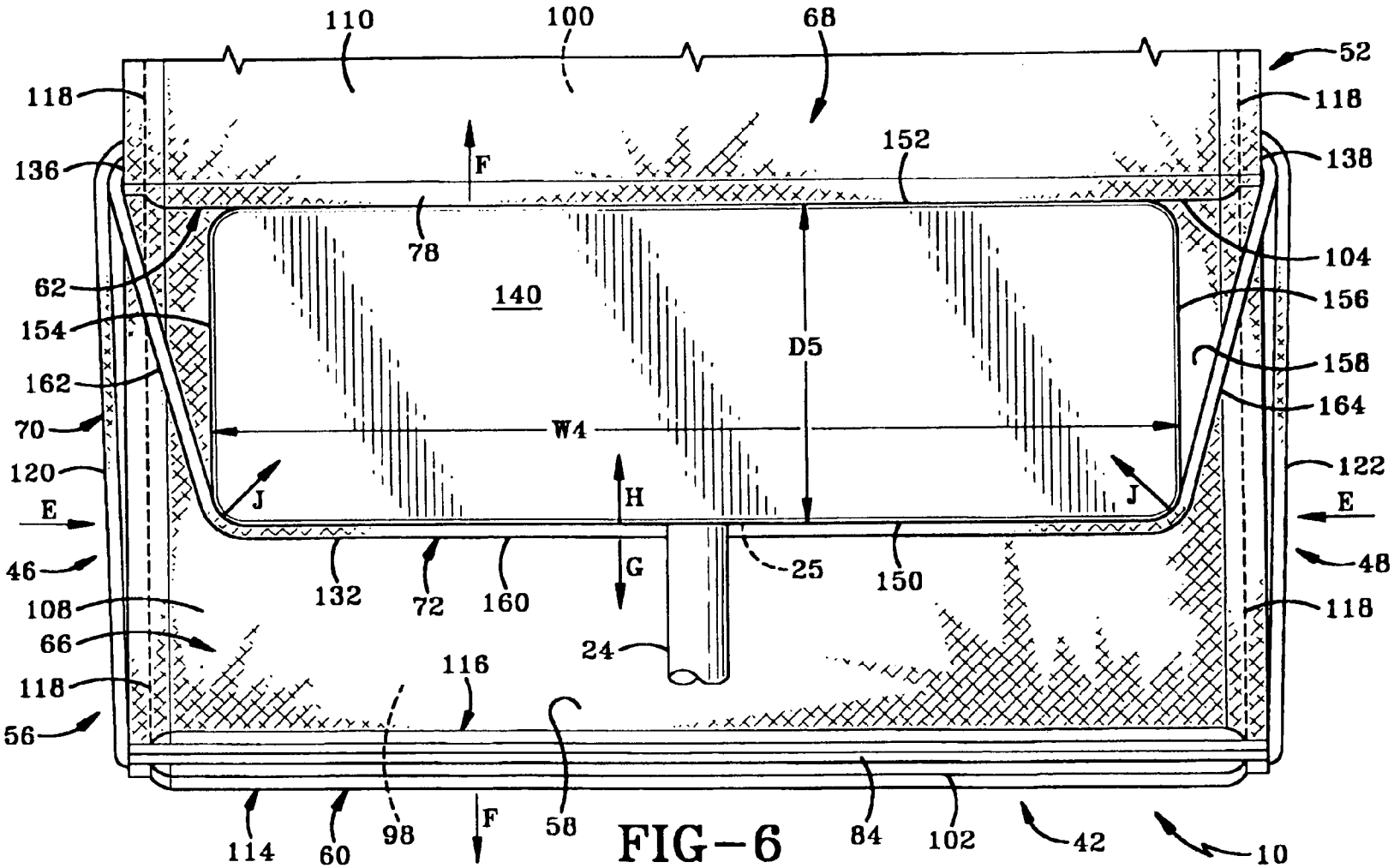
FIG. 6 is a top plan view of the holder with portions cut away with the smaller alarming device held thereby.

The operation of device 10 is described with reference FIGS. 5 and 6. FIG. 5 shows the use of device 10 with larger alarming device 12 and FIG. 6 shows the use of device 10 with a smaller medical alarming device 140. Referring to FIG. 5, body 22 of device 12 has a generally parallelelepiped configuration with a pair of upper axially extending projections 142 at its upper corners and pair of lower axially extending projections 144 at its respective lower corners. Body 22 thus has a main portion 146 from which projections 142 and 144 extend axially outwardly. Main portion 146 has a width W2. Body 22 also includes a lower portion 148 having a width W3 extending between the axially outermost surfaces of projections 144. Width W3 is somewhat wider than width W2. Lower portion 148 and projection 144 has a height H1 which is thus substantially the same as the distance between the upper surface of bottom wall 66 and bottom edge 127 of first strap 70, which is thus the height of each of spaces 129. Body 22 also has a depth D4 (FIG. 2) which is approximately the same as or slightly less than depth D3 (FIG. 4) of space 58. Width W2 (FIG. 5) is somewhat larger than width W1 of space 58, typically about ½ to 1 inch larger although this may vary.

Thus, when larger alarming device 12 is inserted downwardly (Arrow A in FIG. 5) into space 58 of device 10, these various dimensions serve to secure body 22 of device 12 within space 58 to prevent it from falling out inadvertently. More particularly, when body 22 is moved downwardly (Arrow A) into space 58, it slidably engages the inner surface of segments 120 and 122 of first strap 70 so that they are stretched axially outwardly away from one another (Arrows B) from their respective home states shown in FIG. 4 to their respective stretched securing positions shown in FIG. 5. When alarming device 12 includes lower projections 144, the insertion of body 22 into space 58 includes an additional outward stretching of segments 120 and 122 to first accommodate projections 144 as they pass between segments 120 and 122. Once projections 144 move downwardly beyond bottom edge 127 of strap 70, segments 120 and 122 move back inwardly (Arrows C) and rest along the side of main portion 146 of body 22 immediately above lower portion 148 to apply respective inwardly directed opposed forces also represented by Arrows C on the sides of main portion 146. When body 22 is secured in device 10, projections 144 thus extend outwardly beyond side segments 120 and 122 of straps 70 below bottom edge 127 within respective spaces 129. While strap 70 is thus stretched in the securing position shown in FIG. 5, spaces 129 receive projections 144 so that strap 70 is not stretched even further around projections 144 for a greater duration of time, which would otherwise tend to wear out the elastic of strap 70 more quickly.

It was previously noted that S-shaped wall 86 was formed of a substantially rigid material. However, this material typically allows for some flexing particularly along the corners 74, 76, 78 and 80. Thus, when body 22 of device 12 is inserted into space 58, the outward stretching of strap segments 120 and 122 shown at Arrows B in FIG. 5 causes some flexing of wall 86 so that the upper ends of upright walls 60 and 62 move toward one another (Arrows D in FIG. 3) to apply an inward force on the front and rear surfaces of body 22 which is also represented by Arrows D. Thus, during this process, upper terminal edge 84 and top wall 68 move toward one another as indicated at Arrows D. The stretched segments 120 and 122 thus apply rearward and forward pulling forces respectively on front wall 60 and intermediate wall 62 also represented by Arrows D. In the securing position of strap 70 shown in FIG. 5, segments 120 and 122 are thus bowed outwardly so that the inner surfaces thereof generally extend in a concave manner while the outer surfaces thereof are generally convex. When body 22 of device 12 is removed from space 58, segments 120 and 122 of strap 70 elastically return to their home positions as they move inwardly as shown at Arrows E in FIG. 6. In addition, once body 22 is removed from space 58, the upper portions of walls 60 and 62 move away from one another as indicated at Arrows F as they return to their home positions. Body 22 is removable from space 58 simply by manually exerting an upward force on body 22 to overcome the force applied by strap 70 to body 22. During removal, body 22 slidably engages strap 70 as projections 144 force segments 120 and 122 outwardly away from one another. Segments 120 and 122 than move inwardly to their home positions.

Because medical alarming devices come in different sizes, holder 10 is configured to secure such different sizes. In FIG. 6, holder 10 is securing smaller alarming device 140 which has a substantially parallelepiped shape. Device 140 includes a body with front and rear surfaces 150 and 152 defining therebetween a depth D5, and first and second side surfaces 154 and 156 defining therebetween a width W4 of device 140. Depth D5 is substantially less than depth D3 of space 58. Likewise, width W4 is substantially less than width W1 of space 58. Thus, segments 120 and 122 of strap 70 and front and intermediate walls 60 and 62 are not configured to secure device 40 in the same manner as device 12. More particularly, neither of front wall 60 or strap segments 120 and 122 are in contact with smaller device 140. Thus, second strap 72 is provided in order to secure smaller alarming device 140 within the holder portion. More particularly, second strap 72 is stretched so that front segment 132 thereof moves forward as indicated at Arrow G in FIG. 6 to accommodate smaller alarming device 140 within a second smaller alarm device-receiving space 158 which is smaller than and within first space 58. More particularly, space 158 is defined between front segment 132 and upright segment 104 of sleeve 88 of wall 62. As second strap 72 is stretched to the securing position of FIG. 6 to accommodate alarming device 140, strap 72 forms a front stretched segment 160 extending axially parallel to walls 60 and 62, and first and second side stretched segments 162 and 164 which extend from the ends of stretched segment 160 rearwardly and outwardly to adjacent first and second edges 136 and 138 adjacent the upper portion of intermediate wall 62. The rear surface of stretched segment 160 abuts front surface 150 from adjacent first side surface 154 to adjacent second side surface 156 and is thus about the same length as width W4. In the securing position of FIG. 6, strap 72 thus exerts a rearward longitudinal force shown at Arrow H along with lateral inward forces shown at Arrows J on the body of device 140 in order to secure device 40 within space 158. Second strap 72 thus presses device 140 against the front surface of intermediate wall 62.

As previously noted, the body of alarming device 140 has a width W4 and a depth D5 which are respectively less than width W1 and depth D3. However, a medical alarming device may have a body with a width greater than W1 and depth less than D3, or alternately a width which is less than width W1 and a depth which is substantially equal to depth D3. In either case, second strap 72 may be used to secure the body of the device. In the example where the width is greater than width W1, both straps 70 and 72 would engage the body of the device to secure it in holder 10 where as in the alternate example only second strap 72 would engage and secure the device. Thus, second strap 72 may be used in combination with strap 70 or alone in order to secure the body of an alarming device, which has a width or depth which is less than width W1 or depth D3. It is further noted that second strap 72 may be stretched further in order to secure the body of larger device 12 in combination with use of strap 70. However, this is typically not necessary and tends to add to the stretch wear of second strap 72 unnecessarily.

Holder 10 thus provides a device which is conveniently mounted on a support structure such as the headboard of a bed or the seat back of a chair in order to hold medical alarming devices of various sizes to prevent them from falling on the floor so that they are not inadvertently damaged and to prevent inadvertent activation of the alarm. Various changes may be made which are evident to one skilled in the art. However, the simple construction of the present holder provides various advantages some of which have been previously discussed. The use of an outer sleeve which slides onto the headboard or the like without damaging the finished surfaces thereof is one of these advantages. In addition, while the framework of holder 10 may be constructed of materials other than flat plates, the use of flat plates minimizes the space consumed by holder 10 while the intermediate and rear walls provide continuous contact with the front and rear surfaces of the headboard. Flat rear wall 64 when used with a wheelchair minimizes the profile of holder 10 which extends forward of seat back 38 so that holder 10 does not provide an uncomfortable obstruction to person 18 sitting within the chair. Outer sleeve 88 is configured to prevent snagging on clothing 20 of person 18 when seated in wheelchair 34. Thus, holder 10 secures various sizes of medical alarming devices while conveniently securing itself to the supports commonly found in nursing homes or the like.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. A handheld holder for holding a body of a first medical alarming device having an alarming switch and a cord extending outwardly from the switch, the holder comprising:

a mounting portion;

a downwardly opening support-receiving (SR) space formed in the mounting portion adapted for receiving therein a support structure for supporting the holder thereon;

a holder portion;

an upwardly opening medical alarming device-receiving (ADR) space adapted for receiving and supporting the body of the first alarming device therein;

a substantially rigid S-shaped frame;

a flexible S-shaped sleeve encasing the S-shaped frame and defining the SR space and the ADR space; and a first segment of elastic strap which bounds the ADR space and is stretchable movable from a home position to a securing position in which the first segment is adapted to secure the body of the first alarming device within the ADR space.

2. The handheld holder of claim 1 further comprising first and second upwardly extending walls bounding the ADR space; and wherein the first segment extends from the first wall to the second wall.

3. The handheld holder of claim 2 further comprising a second segment of elastic strap which is spaced from the first segment, bounds the ADR space, extends from the first wall to the second wall and is stretchably movable from a home position to a securing position in which the second segment is adapted to secure the body of the first alarming device within the ADR space.

4. The handheld holder of claim 2 further comprising a bottom wall extending between and connected to the first and second upwardly extending walls; and wherein the first segment has a bottom edge which is spaced upwardly from the bottom wall.

5. The handheld holder of claim 1 further comprising a substantially flat upwardly extending first wall bounding the ADR space; and wherein the first segment in the home position is parallel to and closely adjacent or abutting the first wall.

6. The handheld holder of claim 1 further comprising first and second spaced upwardly extending walls; and first and second engaging surfaces respectively on the first and second walls which face one another, bound the SR space and are formed of a non-scratching material whereby the engaging surfaces are adapted to slidably engage opposed finished surfaces of the support structure without scratching the finished surfaces.

7. The handheld holder of claim 1 in combination with a bed having a headboard with front and rear surfaces defining therebetween a thickness of the headboard; and further comprising first and second engaging surfaces on the mounting portion which face one another, bound the SR space and define therebetween a distance which is substantially the same as or slightly larger than the thickness; and wherein the engaging surfaces slidably engage the front and rear surfaces of the headboard during mounting of the holder on the headboard.

8. A handheld holder for holding a body of a first medical alarming device having an alarming switch and a cord extending outwardly from the switch, the holder comprising:

a mounting portion;

a downwardly opening support-receiving (SR) space formed in the mounting portion adapted for receiving therein a support structure for supporting the holder thereon;

a holder portion;

an upwardly opening medical alarming device-receiving (ADR) space adapted for receiving and supporting the body of the first alarming device therein;

first and second upwardly extending walls bounding the ADR space; and a first segment of elastic strap which extends from the first wall to the second wall, bounds the ADR space and is stretchably movable from a home position to a securing position in which the first segment is adapted to secure the body of the first alarming device within the ADR space;

wherein the first and second walls move toward one another in response to movement of the first segment from the home position to the securing position.

9. The handheld holder of claim 8 further comprising a substantially rigid S-shaped frame; and a flexible S-shaped sleeve encasing the S-shaped frame and defining the SR space and the ADR space.

10. A handheld holder for holding a body of a first medical alarming device having an alarming switch and a cord extending outwardly from the switch, the holder comprising:

a mounting portion;

a downwardly opening support-receiving (SR) space formed in the mounting portion adapted for receiving therein a support structure for supporting the holder thereon;

a holder portion;

an upwardly opening medical alarming device-receiving (ADR) space adapted for receiving and supporting the body of the first alarming device therein;

a first segment of elastic strap which bounds the ADR space and is stretchably movable from a home position to a securing position in which the first segment is adapted to secure the body of the first alarming device within the ADR space; and a second segment of elastic strap which is stretchably movable from a home position to a securing position; and wherein the second segment in its home position extends transversely to the first segment in its home position; the second segment in its securing position is disposed adjacent the ADR space and bounds a smaller space adjacent the ADR space; the smaller space is adapted to receive therein a body of a second medical alarming device having a depth or width which is smaller than that of the body of the first alarming device; and the second segment is adapted to secure the body of the second alarming device within the smaller space.

11. A handheld holder for holding a body of a first medical alarming device having an alarming switch and a cord extending outwardly from the switch, the holder comprising:

a mounting portion;

a downwardly opening support-receiving (SR) space formed in the mounting portion adapted for receiving therein a support structure for supporting the holder thereon;

a holder portion;

an upwardly opening medical alarming device-receiving (ADR) space adapted for receiving and supporting the body of the first alarming device therein;

a first upwardly extending wall;

a first segment of elastic strap which bounds the ADR space and is stretchably movable from a home position to a securing position in which the first segment is adapted to secure the body of the first alarming device within the ADR space; and wherein the first segment is mounted on the first wall and when stretched to the securing position loops outwardly from the first wall so that the first wall and first segment define a closed loop around the ADR space.

12. The handheld holder of claim 11 further comprising a substantially rigid S-shaped frame formed as an integral one-piece member and comprising front, intermediate and rear upright walls, a bottom wall extending between and connected to the front and intermediate upright walls, and a top wall extending between and connected to the intermediate and rear walls; and wherein the SR space is disposed between the intermediate and rear walls; and the ADR space is disposed between the front and intermediate walls; and the first wall is one of the upright walls.

13. The handheld holder of claim 12 wherein the frame is formed from a single sheet of metal bent into the S-shaped configuration.

14. A handheld holder for holding a body of a first medical alarming device having an alarming switch and a cord extending outwardly from the switch, the holder comprising:

a mounting portion;

a downwardly opening support-receiving (SR) space formed in the mounting portion adapted for receiving therein a support structure for supporting the holder thereon;

a holder portion;

an upwardly opening medical alarming device-receiving (ADR) space adapted for receiving and supporting the body of the first alarming device therein;

a substantially rigid S-shaped frame;

a flexible S-shaped sleeve encasing the S-shaped frame and defining the SR space and the ADR space;

first and second uprights on opposed sides of the ADR space; and first and second sheets of textile material mounted respectively on the first and second uprights.

15. The handheld holder of claim 14 wherein the sleeve is formed of a textile material.

16. The handheld holder of claim 15 further comprising a first segment of elastic strap which bounds the ADR space and is stretchably movable from a home position to a securing position in which the first segment is adapted to secure the body of the first alarming device within the ADR space.

17. The handheld holder of claim 14 further comprising a first segment of elastic strap which is mounted on the first sheet of textile material and is stretchably movable from a home position to a securing position in which the first segment is adapted to secure the alarming device within the ADR space.

18. The handheld holder of claim 17 wherein the first segment extends from the first sheet to the second sheet.

19. The handheld holder of claim 17 wherein the first segment and the first sheet together form a closed loop.

20. A handheld holder for holding a body of a first medical alarming device having an alarming switch and a cord extending outwardly from the switch, the holder comprising:

a mounting portion;

a downwardly opening support-receiving (SR) space formed in the mounting portion adapted for receiving therein a support structure for supporting the holder thereon;

a holder portion;

an upwardly opening medical alarming device-receiving (ADR) space adapted for receiving and supporting the body of the first alarming device therein;

a substantially rigid S-shaped frame;

a flexible S-shaped sleeve encasing the S-shaped frame and defining the SR space and the ADR space;

first and second spaced upwardly extending walls; and first and second engaging surfaces respectively on the first and second walls which face one another, bound the SR space and are formed of a non-scratching material whereby the engaging surfaces are adapted to slidably engage opposed finished surfaces of the support structure without scratching the finished surfaces; wherein the engaging surfaces are formed of a textile material.

* * * * *

UNITED STATES PATENT AND TRADEMARK OFFICE

CERTIFICATE OF CORRECTION

PATENT NO. : 7,494,102 B1
APPLICATION NO. : 11/906357
DATED : February 24, 2009
INVENTOR(S) : Robert B. Deal It is certified that error appears in the above-identified patent and that said Letters Patent is hereby corrected as shown below:

Claim 1

Column 10, lines 18-19 change "stretchable" to "stretchably" that sentence reads -- which bounds the ADR space and is stretchably movable from a --

Signed and Sealed this

Seventh Day of April, 2009

JOHN DOLL
*Acting Director of the United States Patent and Trademark Office*